US009909299B2

(12) United States Patent
Christie et al.

(10) Patent No.: US 9,909,299 B2
(45) Date of Patent: Mar. 6, 2018

(54) TRUSS ASSEMBLY AND METHOD OF CONSTRUCTING A TRUSS STRUCTURE

(71) Applicant: CHRISTIE LITES ENTERPRISES CANADA INC., Toronto (CA)

(72) Inventors: Huntly Gordon Christie, Windermere, FL (US); Percy Adler, Consecon (CA)

(73) Assignee: CHRISTIE LITES ENTERPRISES CANADA INC., Toronto (CA)

( * ) Notice: Subject to any disclaimer, the term of this patent is extended or adjusted under 35 U.S.C. 154(b) by 0 days.

(21) Appl. No.: 15/088,720

(22) Filed: Apr. 1, 2016

(65) Prior Publication Data

US 2017/0284082 A1 Oct. 5, 2017

(51) Int. Cl.
*E04B 1/48* (2006.01)
*E04C 3/08* (2006.01)

(52) U.S. Cl.
CPC . *E04B 1/48* (2013.01); *E04C 3/08* (2013.01)

(58) Field of Classification Search
CPC ..... E04B 1/48; E04C 3/08
See application file for complete search history.

(56) References Cited

U.S. PATENT DOCUMENTS 6,321,501 B1 * 11/2001 Ignash ..... E04C 3/005 52/641
6,419,175 B1 * 7/2002 Rankin, VI ..... A45F 5/004 242/373
8,627,633 B2 * 1/2014 Davies ..... E04B 7/022 52/641
2012/0152798 A1 * 6/2012 Allegretti ..... B65D 19/06 206/599

* cited by examiner

*Primary Examiner* — Patrick J Maestri
(74) *Attorney, Agent, or Firm* — DLA Piper LLP (US); Jennifer E. Lacroix

(57) ABSTRACT

Pins are stored on a truss body and are used to secure connections between separate truss bodies when creating a truss structure, which itself may act as a support for displays, lighting systems, and/or sound systems. Each of the pins is tethered to a pin holder so as not to be lost or damaged. The pin holder retains the pins on the truss body and thereby reduces the likelihood of collisions that occur between the tethered pins and truss members while the truss assembly is in transit. This in turn increases the likelihood that the structural integrity of the pins, the truss members and the tether is maintained during transit. The pin holder and tether allow the correct number of pins to be shipped to the venue where the truss structure is to be constructed.

16 Claims, 3 Drawing Sheets

TRUSS ASSEMBLY AND METHOD OF CONSTRUCTING A TRUSS STRUCTURE

FIELD OF THE INVENTION

The present invention generally relates to a truss assembly that may be combined together with other such truss assemblies to provide a single truss structure, which acts as a support for displays, lighting systems, or sound systems for concerts, festivals, trade shows or in theatres, etc.

BACKGROUND OF THE INVENTION

Truss assemblies may be used in a variety of industries, including the entertainment industry, where they are used for the construction of truss structures with lighting, cameras, displays, and speaker systems mounted thereon. Truss structures are often used in entertainment (and in particular concert) venues for this purpose. Although the present application is not limited to any one particular use, it will refer to concerts as an exemplary use.

Although some means are needed to secure lighting, sound, camera, and display equipment for concerts, not all entertainment venues are equipped with such means. Accordingly, in some cases truss assemblies are transported to the venue and a truss structure is assembled on site. Because renting of a venue is costly, it is desirable for truss structures to be assembled and disassembled quickly to minimize rental costs. Assembling such a truss structure can be large and complex job.

Truss structures are typically constructed by placing truss assemblies adjacent to one another and joining them together. In order to form a single unitary whole, each truss assembly comes equipped with a mechanism by which it may be coupled to other truss assemblies. The coupling mechanism generally comprises a set of connection openings that may be aligned as between separate truss assemblies and through which pins may be inserted to create firm connection points.

Truss assemblies are normally shipped out to venues from a central storage facility or possibly from a set of disparate storage facilities. Pins must be present at the venue in order for the truss sections to be assembled. Pins may be sourced from a different manufacturer than truss assemblies. Pins sourced separately are then packaged with the truss assemblies at the storage facilities before shipment to their final destinations. This creates a possible problem wherein there is a chance or likelihood that pins are packaged with the truss assemblies in incorrect quantities or pin packages are missing from truss assemblies altogether. Packaging errors are normally not discovered until the equipment arrives at the venue. If pins are missing, the truss assemblies cannot be assembled into a unitary structure and time is wasted while the workers wait for further pins to arrive on site.

Furthermore, during the assembly of the truss structure, workers necessarily find themselves at times working at heights atop partially completed truss structures. If a worker finds that a pin has slipped from their hands and fallen to the ground, the pin may be damaged or lost. This again may result in additional time required to replace or locate the pin.

BRIEF DESCRIPTION OF THE DRAWINGS

The following drawings illustrate examples of various components of the invention disclosed herein, and are for illustrative purposes only. Other embodiments that are substantially similar can use other components that have a difference appearance.

DETAILED DESCRIPTION

Figure 1:
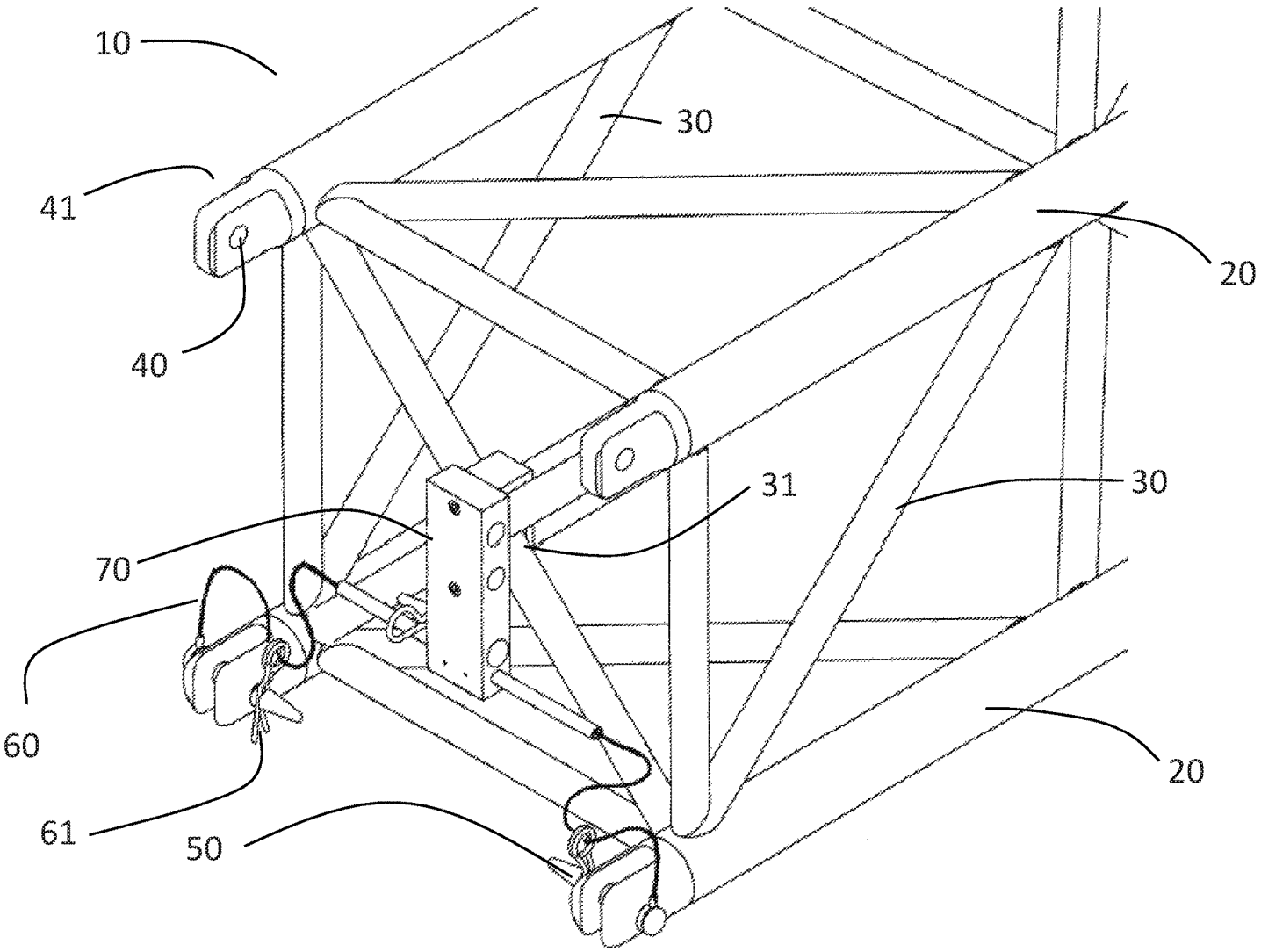
FIG. 1 is a schematic of a preferred embodiment of a truss assembly depicting an end thereof with a holder and plurality of pins attached thereto by a tether.

The present invention relates to the storage and management of pins to allow efficient and faster assembly of truss structures.

In one embodiment of the present invention provided is a truss assembly, comprising a truss body having a pair of ends, each end comprising at least two connection openings adapted to correspond to connection openings of a second truss body. Provided also are at least two pins, each insertable into the connection openings of the truss body and the second truss body, whereby the connection openings of the truss body and the connection openings of the second truss body align and the pins may be inserted through the aligned openings. A holder is also provided with the truss body for holding the pins in place.

In one embodiment of the present invention the holder is integral with the truss body.

In another embodiment of the present invention, truss body further comprises at least two spaced apart parallel elongated members connected by at least two cross members attached to the elongated members and the holder is mounted to the at least one of the cross members. In a further embodiment of the present invention, the holder further comprises a U-shaped arm for mounting it to at least one of the at least two cross members.

In a further embodiment of the present invention each of the at least two of pins has a tether connected to and extending from each pin for attaching each to the holder.

In a further embodiment of the present invention the tether from each pin is wound in a spring loaded retractable reel connected to the holder that allows each tether to retract.

In a further embodiment of the present invention holder comprises at least one guiding member mounted to the holder and extending outwardly from each side of the holder, wherein the tether from each pin is attached to the at least one guiding member, whereby the tethers extend along the length of the guiding member. In a further embodiment, the at least one guiding member is hollow and the tether from each pin is attached within the hollow of the at least one guiding member and extends along the length of the guiding member.

In a further embodiment of the present invention the assembly further includes a clip for each of the at least two pins to further secure each pin in each connection opening. In a further embodiment of the present invention the clips are slidably attached to the tether from each pin. In an even further embodiment of the present invention R pins are used as the clips.

In a further embodiment of the present invention the pins are ferromagnetic and the holder is magnetized to allow the pins to adhere to it due to the magnetic force.

In another embodiment of the present invention provided is a truss assembly, comprising a truss body, which itself comprises a plurality of spaced apart parallel elongated members connected by a plurality of cross members attaching to the elongated members, the ends of each of the elongated members comprising connection openings, the ends sized to slidably receive corresponding ends of a second truss body thereby allowing the connection openings to align. Provided also are a plurality of pins, each insertable into the aligned connection openings of the elongated members of the truss body and the second truss body to secure a connection between the truss bodies. Provided also is a holder, comprising a plurality of spaces into which the plurality of pins can be placed for storage and a guiding member extending outwardly from the body. Further provided is a U-shaped arm that fastens to the body of the holder and defines a space capable of allowing at least one cross member to pass there through. A tether is also provided extending from each of the pins and attached to the guiding member such that the tethers extend along the length of the guiding member.

A further embodiment of the present invention comprises a method of constructing a truss structure comprising at least two truss assemblies, each truss assembly having at least two connection openings at each end of the truss assembly and a holder having spaces for holding pins, each pin being tethered to the holder by a tether, wherein the pins are stored in the holder, the method including the steps of aligning the connection openings of one of the at least two truss assemblies to the connection openings of another of the at least two truss assemblies; removing pins from a holder; and, inserting the pins into aligned connection openings.

In another embodiment of the present invention the method of constructing the truss structure further involves clipping an R pin to an end of each pin after each pin is placed in the aligned connection openings to secure the pin therein.

In a further embodiment of the present a pin holder is provided that is capable of attaching to a truss body, comprising a body and at least two pins, the body comprising at least two spaces into which the at least two pins can be placed for storage. The pin holder further comprises a mounting member for mounting the pin holder to the truss body and a tether extending from each of the at least two pins for keeping the pins attached to the body, each tether being fixed within the hollow guiding member.

In a further embodiment of the present invention a hollow guiding member is mounted to the body of the pin holder and the ends of the guiding member extend outwardly from the body, and the tethers extend along the length of the guiding member.

In a further embodiment of the present invention, the fastener for attaching the body of the pin holder to the truss body comprises a U-shaped arm capable of being fastened to the body of the pin holder, wherein the U-shaped arm and the body of the pin holder define a gap for allowing at least one member of a truss body to pass there through.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents, which operate in a similar manner to accomplish a similar purpose.

Reference will now be made to FIG. 1, which provides a detailed schematic of a preferred embodiment of the truss assembly of the present invention. The truss assembly comprises a truss body 10 that may be constructed of at least two spaced apart, parallel elongated members 20 but may also be constructed of four such spaced apart parallel elongated members. The parallel elongated members 20 may be constructed of rigid materials such as, for example, steel or other suitable alloy, aluminum or other suitable metal, or wood.

The parallel elongated members 20 are connected together by a plurality of cross members 30 extending there between. The connection between the parallel elongated members 20 and the cross members 30 can be made in any manner known in the art, for example, via weld or bolt. The cross members 30 can also be constructed of a rigid material such as, for example, steel or other suitable alloy, aluminum or other suitable metal, or wood.

In one embodiment, a plurality of cross members 30 are provided that span the length of the parallel elongated members 20 in a diagonally alternating fashion and connect the parallel elongated members 20 in both a vertical and horizontal manner. In a preferred embodiment, a number of the cross members 30 create an angle of between 30° and 60° with the parallel elongated member 20 to which they are attached. Other cross members 30 may be arranged perpendicular to the parallel elongated members 20 to which they attach. In the embodiment depicted in FIG. 1, two cross members 30 are shown to cross each other near one end of the truss body 10, thereby forming a junction 31.

Figure 5:
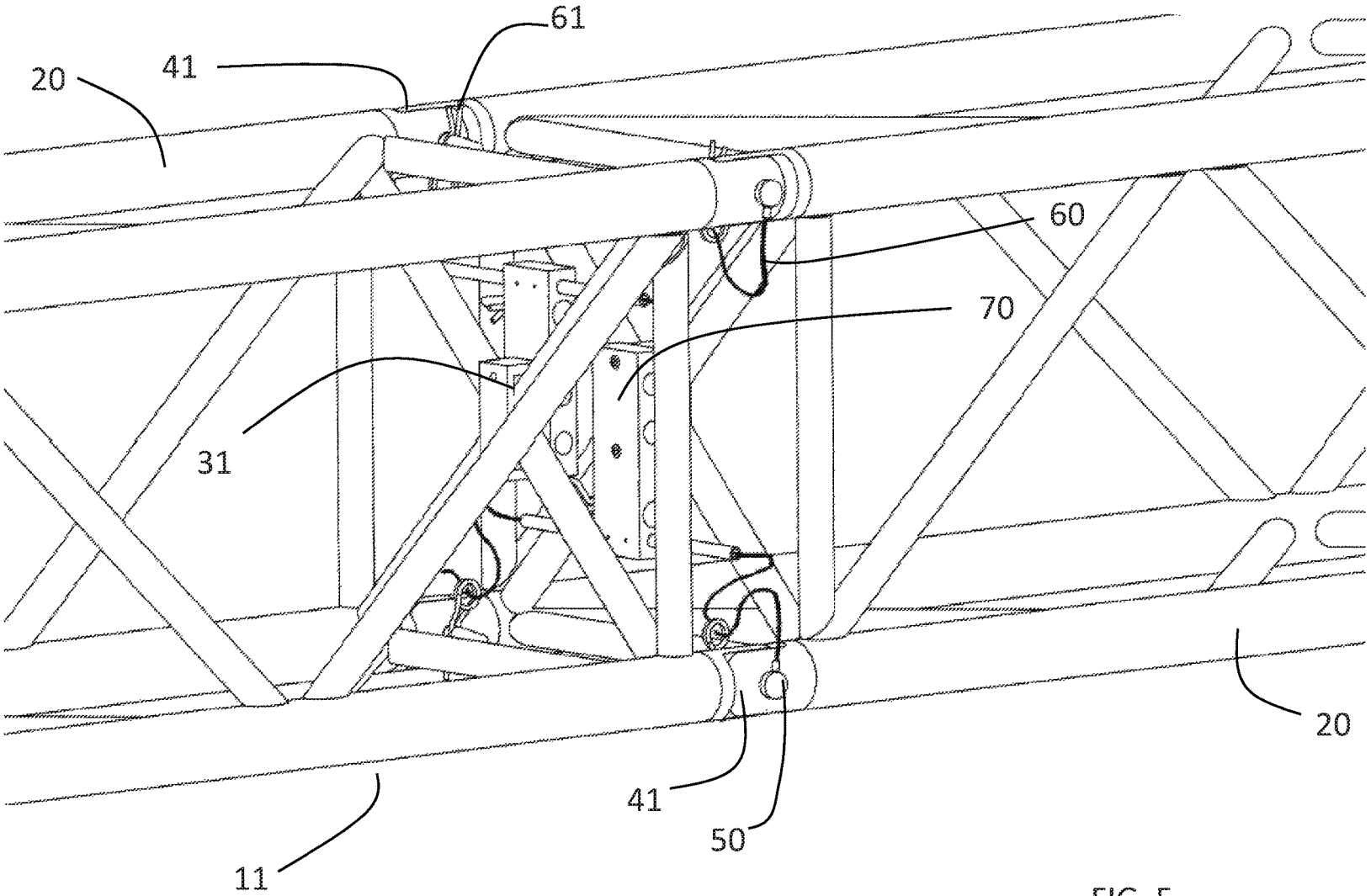
FIG. 5 is a schematic of a connection of a truss structure formed by connecting two truss assemblies together.

The parallel elongated members 20 contain connection openings 40 at each of their ends, which may be integral with the elongated members 20 themselves or integral with end pieces 41 attached to the ends of the elongated members. In either case, the ends or end pieces 41 of the elongated members 20 are sized to slidably receive an end or end piece of an elongated member of at least a second truss assembly. In constructing a truss structure 11, as can be seen in FIG. 5, the connection openings 40 of one truss assembly align with the connection openings of a second truss assembly and a pin 50 is placed through the aligned connection openings to secure the connection between them.

Cross members 30 run the length of the parallel elongated members 20, terminating at their ends. In a preferred embodiment, cross members 30 proximate to both ends of the parallel elongated members 20 are provided and connect to diagonally opposed parallel elongated members 20 and thereby cross one another, forming a junction 31 as can be seen in FIGS. 1 and 5.

In one embodiment, provided are at least two pins 50. The pins 50 may be made of any suitably rigid material, such as, for example, wood, steel or other metal alloy. The pins 50 may be threaded, similar to bolts or screws, or may be non-threaded. Threaded pins 50 may further secure the connection between truss assemblies given connection openings 40 that are correspondingly threaded.

The pins 50 are adapted to be inserted into connection openings 40 of the parallel elongated members 20 to secure a connection between two truss bodies 10 when the connection openings of the two are aligned, thereby forming a truss structure 11. Pins 50 inserted into the connection openings 40 can be seen in FIGS. 1 and 5. Inserting each of the pins 50 through the aligned connection openings 40 of the parallel elongated members 20 creates a secure connection there between.

In a preferred embodiment, each truss body 10 may be provided with a set of pins 50. Each pin 50 may be associated with each connection opening 40 in the parallel elongated members 20 at one end of the truss body 10. Also provided may be an extra pin 51, which is not necessarily associated with any connection opening. The extra pin is a redundant measure, which ensures that the required number of pins is always present at a particular venue. The extra pin 51 also allows assembly of the truss structure 11 even if one of the other provided pins 50 is damaged. The extra pin 51 may be constructed in the same manner and of the same material as the other pins 50; it may also be threaded or non-threaded for the reason noted above.

Provided on each of the pins 50 and extending therefrom is a tether 60. The tether 60 creates an attachment as between each of the pins 50 and a pin holder 70. The tether 60 attaches each of the pins 50 to the truss body 10 and ensures that a correct number of pins 50 are always shipped with their associated truss body 10. The tether 60 also prevents the pins 50 from being inadvertently lost or damaged if they happen to slip from the hand of a worker while that worker is joining truss assemblies together to create a truss structure 11. The tether 60 can be a metal cable or wire or any suitable material known in the art. The connection between the tether 60 and the pin holder may be made by way of any type of fastener.

In a further embodiment, the tether 60 is wound in a spring loaded retractable reel. When pins 50 are not in use, tether 60 is retracted into the retractable reel to reduce the length of the tether 60. This allows pins 50 to move freely in all directions. The retractable reel also permits the tether to be lengthened far enough to allow each pin 50 to be inserted into a connection opening 40. A retractable reel also keeps the tether 60 taut at all times, reducing the risk that the tether 60 is snared by another member of the truss body 10. A spring mechanism is provided to retract the tether 60 to its minimum length when no force other than the weight of one of the pins 50 is exerted on it. The spring mechanism may be overcome with minimal force, such as that exerted by a worker, to extend the tether 60 to any required length.

Each tether 60 may connect to any point on any one of the pins 50. The tether 60 may also connect to any part of a pin holder 70 body as long as the tether 60 is long enough or can be extended long enough to allow each pin 50 to easily transition from between its storage space 73 in the pin holder 70 and a connection opening 40 of a truss body 10. In a preferred embodiment of the present invention, the tether 70 is attached to a guiding member 74, as will be explained below.

The pin holder 70 provides a means for storing pins 50 when they are not being used to secure connections between separate truss bodies 10. The holder 70 may be integral with the truss body 10, or it may be separate and suitably attachable thereto.

Figure 3:
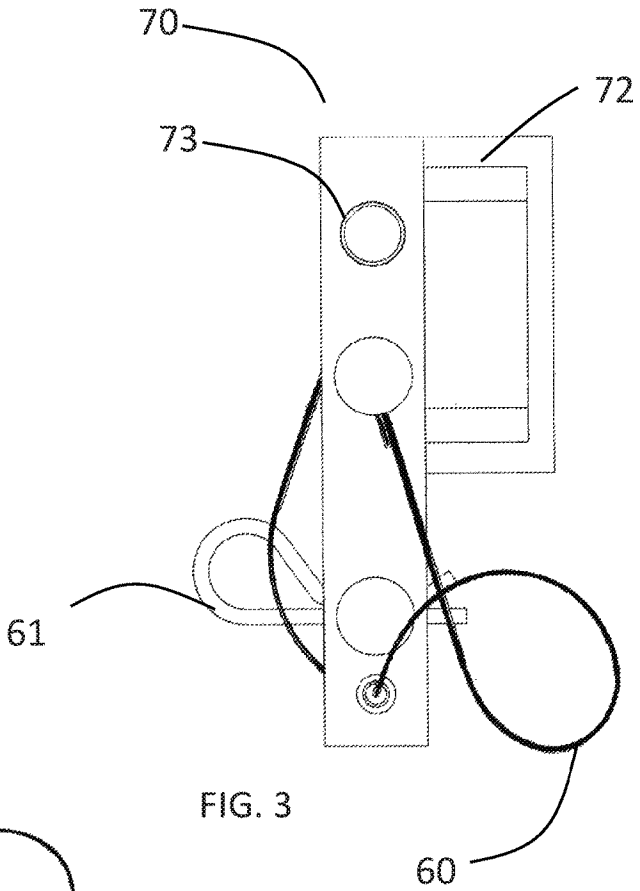
FIG. 3 is a side view of a preferred embodiment of a holder.
Figure 2:
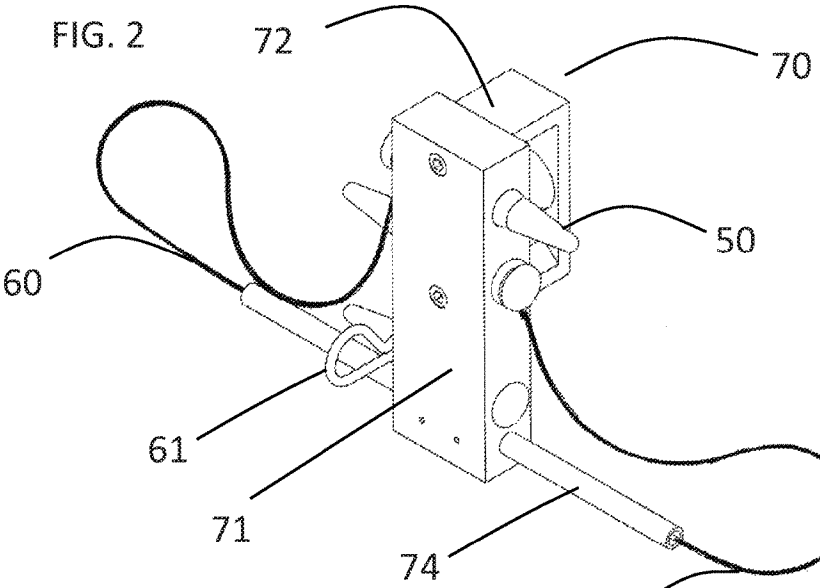
FIG. 2 is an isometric view of a preferred embodiment of a holder.
Figure 4:
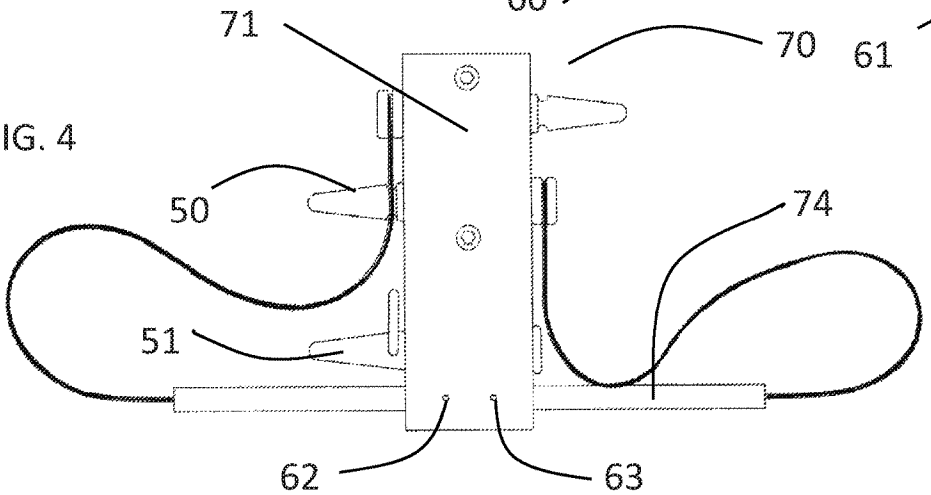
FIG. 4 is a front view of a preferred embodiment of a holder.

FIGS. 2, 3 and 4 provide a perspective, a side and a front view, respectively, of an exemplar holder 70 whose body is not integral with the truss body 10. The holder 70 may be constructed of any sufficiently strong plastic, metal or wood, or any other suitable material known in the art. A 3D printer may be employed to print the pin holder 70.

In a preferred embodiment, the holder 70 is attached to a cross member 30, while in a more preferred embodiment, the holder 70 is attached to the junction 31 where cross members proximate to each of the ends of the parallel elongated members 20 cross one another, as can be seen in FIGS. 1 and 5.

As can be seen in FIGS. 2, 3 and 4, an example holder 70 is comprised of a body 71 and a U-shaped arm 72 extending therefrom. The U-shaped arm 72 allows the holder to attach to a cross member 30 of the truss body 10 or an elongated member 20 by allowing the cross member 30 or elongated member 20 to pass through the area created between the body 71 of the holder 70 and its U-shaped arm 72. Alternatively, the U-shaped arm 72 may be configured to be large enough to fit around the junction 31 where two cross members 30 of the truss body 10 cross. The holder may be connected to the cross member 30, the junction 31, or to any part of the truss body 10 by any suitable means known in the art. The U-shaped arm 72 may screw into the body 71 of the holder or may be attached thereto in any manner known in the art.

In one embodiment, the holder 70 may be integral with either the parallel elongated members 20 or the cross members 30 of the truss assembly. In such an embodiment either the parallel elongated member 20 or the cross member 30 comprises the body of the holder 70.

The holder 70 provides spaces 73 for storing the pins 50 while the truss assembly is in transit to, for example, the location of a concert, or at any time when the pins 50 are not being used. In this manner, the holder 70 allows the pins 50 to be shipped together with their associated truss body 10 in the correct quantity. The holder 70 also prevents pins 50 from hanging freely on their associated tethers 60, thereby reducing the risk of damage from occurring to the pins 50, the truss body 10, or the tether 60. The holder 70 prevents the pins 50 from colliding with the truss body 10 causing structural damage to either one or the other, or both. Structural damage to either the pins 50 or the truss body 10 undermines the integrity of the resulting truss structure 11, leaving it more susceptible to collapse. Damage to the tether 60 may cause it to shear, tear or snap, resulting in the pins 50 detaching from the truss body 10 and creating a situation where the pins 50 become lost and time is wasted at the concert site waiting for replacement pins to arrive.

In a preferred embodiment, the body 71 of the holder 70 is provided with spaces 73 into which pins 50 may be inserted for storage. An extra space may also be provided to store an extra pin 51. A further embodiment of the current invention utilizes an O-ring to help secure the pins 50 within the designated spaces 73 in the body 71 of the pin holder 70.

In a further embodiment of the present invention, as can also be seen in FIGS. 2, 3 and 4, provided is a guiding member 74 that extends through the bottom of the body 71 of the pin holder 70 and further extends outwardly from the body 71. Each tether 60 may attach to a space on the guiding member 74. In one embodiment, the guiding member 74 is hollow, which allows each tether 60 to be threaded through the guiding member 74. Each tether 60 is capable of being threaded into the hollow guiding member 74 up to about the bar's mid-point. Near the midpoint of the guiding member 74, a screw or other fastener known in the art may be inserted in the body 71 of the pin holder 70 through apertures 62 and 63 to secure the tether 60 within the hollow of the guiding member 74.

In the embodiment illustrated in FIG. 1 the guiding member 74 extends outwardly from the body 71 of the pin holder 70 in a direction that is towards the connection openings 40 of the elongated members 20. In this manner the effective length of the tether 60 connected to each pin 50 is minimized. The shortened effective length of the tether 60 means it is less likely to tangle and snap during transport.

In an alternative embodiment of the present invention the pins 50 are ferromagnetic and the holder 70 is magnetized. In this manner, the pins 50 are held in place on the holder 70 by way of an attraction created by an electromagnetic force as that exists between the magnetized holder 70 and the ferromagnetic pins 50.

As can best be seen in FIGS. 2, 3 and 4, in another embodiment of the invention, provided on each tether 60 are R pins 61. Once any of the pins 50 are inserted into aligned corresponding connection openings 40 of two truss bodies 10, the connection may be further secured by clipping a corresponding R pin 61 to the end of each of the pins 50. Clipping R pins 61 onto the ends of pins 60 while they are placed in the connection openings 40 prevents the pins from sliding out therefrom and further secures the connections that form the truss structure 11.

Provided also is a method for constructing a truss structure 11, as is best seen in FIG. 5. The truss structure 11 constructed with the provided method comprising truss bodies 10 joined together by way of secure connections comprising pins 50 inserted through aligned connection openings 40 of separate truss bodies 10.

Truss bodies 10 are shipped out to venues along with pins 50 held in the holder 70 and attached to the truss body 10 by way of a tether 60. Once at least two truss assemblies arrive at a desired location, a worker aligns the connection openings 40 in the parallel elongated members 20 of one truss body 10 with the same openings 40 of a second truss body.

The connection openings 40 may be integral with the ends of the elongated members 20 or may be integral with end pieces 41 attached to the ends of the elongated members 20. The ends of the elongated members 20 or their end pieces 41 are sized to slidably receive an end or end piece 41 of an elongated member 20 of a second truss body.

Once the connection openings 40 are aligned, a worker may remove pins 50 from the holder 70 where they have been held during transit. The holder 70 may be integral with and therefore comprise a location on the truss body 10 or may be secured thereon. In either case, when the pins 50 are stored in the holder 70, they are protected from potential damage in transit. For example, if pins 50 were permitted to dangle by the tether 60 without the holder 70, there would be a risk of damage to the pins 50 or the truss body 10 as a result of collisions that could occur in transit.

In one embodiment, the pins 50 are stored in spaces 73 located in the body 71 of the holder 70. In such an embodiment, the worker removes the pins 50 by sliding them out from within the spaces 73.

A further embodiment of the present invention utilizes pins 50 that are ferromagnetic and that are held in place on a magnetized holder 70. In this embodiment, the worker needs only to pull the pins 50 with sufficient force to overcome the electromagnetic force present between the pins 50 and the holder 70 to remove the pin 50 from the holder 70.

Once one of the pins 50 is removed from the holder 70 it can be freely moved from holder 70 to connection opening 40, while staying attached to the body of the pin holder 70 by way of a tether 60. In one embodiment, a retractable tether 60 comprising a spring loaded reel may be provided to facilitate the free movement of the pins 50 and to ensure that the tether 60 is long enough to conduct the necessary movements. Excess tether 60 may be retracted into storage means by way of a spring mechanism or any suitable mechanism known in the art. In another embodiment, the length of the tether 60 may be shortened by the addition of a guiding member 74 that extends outwardly from the pin holder 70 and to which the tether attaches.

Pins 50 that have been removed from the holder 70 can be inserted into aligned connection openings 40 of separate truss bodies to secure the connection between them. Truss bodies 10 already connected together may connect to further truss bodies to form a larger truss structure 11 as can be seen in FIG. 5. Truss structures can take any shape known in the art suitable for, for example, concert staging.

In a preferred embodiment, provided also are R pins 61. Each of the tethers 60 passes through the circular part of the R pin 61, thereby keeping it in place during transit. A worker can clip each R pin 61 onto each pin 50 after it has been inserted in the corresponding connection opening 40. Clipping an R pin 61 onto each pin 50 in each connection opening 40 helps to secure that pin 50 in place and thereby reinforces the connection in a truss structure 11.

The present invention provides a tether 60 (such as a cable or wire) to secure pins 50 to the body 10 of a truss so that the pins 50 are less likely to be lost during transport or dropped during assembly. A pin 50 that is left to freely hang by its tether 60 is susceptible to damage while in transport. Forces acting on the pin 50 during transit may cause it to swing and come in contact with parts of the truss body 10. Allowing such contact between any of the pins 50 and the truss body 10 may cause damage to one or the other, or both. Pins 50 that are damaged may no longer be structurally sound enough to secure one truss body 10 to another. During assembly, the structural integrity of a pin 50, or lack thereof, may not in all instances be ascertained by a visual inspection and damaged pins 50 could be unknowingly used by workers to create a truss structure 11. Bent pins 50 could easily be identified and not used; however, pins 50 suffering internal structural damage from repeatedly coming into contact with the truss would not be so easy to identify. Because a truss structure 11 is often used to support many heavy audio/visual components, it is extremely dangerous for workers to unknowingly use pins 50 that are not structurally sound. Even if damage to the pins 50 is discovered, time is wasted due to the need to locate replacement pins 50 before the truss structure 11 can be completed.

If the pins 50 are left to hang freely when a truss assembly is in transit, friction and shear may be created between members of the truss body 10 and the tether 60 upon which each of the pins 50 are hanging. Due to the length of each tether 60, it may also become tangled. If enough friction is created during transit the resulting shear on the tether 60 may structurally weaken it or may cause it to tear snap altogether. Furthermore, a tether 60 that is tangled around a member of the truss body 10 is more apt to snap when forces are exerted on it than a straight wire. If the tether 60 snaps, the pins 50 will no longer be attached to the truss body 10 and may easily be lost or damaged in transit. Pins 50 may also become detached from the truss body 10 and therefore lost or damaged if the tether 60 becomes pinched between structural members of the truss body 10 itself or between the truss body 10 and its shipping container and forces in transit cause the tether 60 to sever at the pinch point.

The present invention better enables the correct storage and management of pins 50 such that the correct number of pins 50 is shipped with each truss body 10 every time such a body is shipped, thereby avoiding wasted construction time caused by shipping an incorrect number of pins 50. The present invention also provides a means of securely holding and storing the pins 50 so that neither they nor their tethers 60 are damaged while in transport or at any time prior to assembly.

Although embodiments of the present invention have been described above and are illustrated in the accompanying drawings in order to be more clearly understood, the above description is made by way of example and is not meant to limit the scope of the present invention. It is contemplated that various modifications apparent to one of ordinary skill in the art could be made without departing from the scope of the invention which is to be determined by the following claims.

The invention claimed is:

1. A truss assembly, comprising:

a truss body comprising a plurality of spaced apart parallel elongated members connected by a plurality of cross members attaching to the elongated members, the ends of each of the elongated members comprising connection openings, the ends sized to slidably receive corresponding ends of a second truss body thereby allowing the connection openings to align;

a plurality of pins, each insertable into the aligned connection openings of the elongated members of the truss body and the second truss body to secure a connection between the truss bodies;

a holder comprising a plurality of spaces into which the plurality of pins can be securably placed for storage and at least one guiding member extending outwardly from the body;

a U-shaped arm that fastens to the body of the holder and defines a space capable of allowing at least one cross member to pass there through;

a tether extending from each of the pins and attached to the guiding member such that the tethers extend along the length of the guiding member;

whereby when the pins are secured to the holder, the pins are prevented from movement relative to the truss body.

2. The truss assembly of claim 1 wherein the assembly further comprises a clip for each of the at least two pins to secure each pin in each connection opening.

3. The truss assembly of claim 1 wherein the tether from each pin is wound in a spring loaded retractable reel connected to the holder that allows each tether to retract.

4. The truss assembly of claim 1 wherein the at least one guiding member is hollow and the tether from each pin is attached within the hollow of the at least one guiding member and extends along the length of the guiding member.

5. The truss assembly of claim 1 wherein the clips are slidably attached to the tether from each pin.

6. The truss assembly of claim 5 wherein the clips are R pins.

7. The truss assembly of claim 1 wherein the holder is integral with the truss body.

8. The truss assembly of claim 1 wherein the pins are ferromagnetic and the holder is magnetized to allow the pins to adhere to it due to the magnetic force.

9. A pin holder capable of attaching to a truss body, comprising:

a body and at least two pins, the body comprising at least two spaces into which the at least two pins can be placed for storage;

a mounting member for mounting the pin holder to the truss body; and a tether extending from each of the at least two pins for keeping the pins attached to the truss body, at least one hollow guiding member mounted to the body, the ends of the guiding member extending outwardly from the body, wherein the tethers attach to the guiding member within the hollow and extend along the length of the guiding member, whereby when the pins are placed into the spaces in the holder, the pins are restricted from movement relative to truss body.

10. The pin holder of claim 9 wherein the mounting member for mounting the body of the pin holder to the truss body comprises a U-shaped arm capable of being fastened to the body of the pin holder, wherein the U-shaped arm and the body of the pin holder define a gap for allowing at least one member of a truss body to pass there through.

11. The pin holder of claim 9 wherein clips are slidably attached to the tether from each pin.

12. The pin holder of claim 9 wherein the tether from each pin is wound in a spring loaded retractable reel connected to the holder that allows each tether to retract.

13. The pin holder of claim 9 wherein the pin holder further comprises a clip for each of the at least two pins to secure each pin in each connection opening.

14. The pin holder of claim 13 wherein the clips are R pins.

15. The pin holder of claim 9 wherein the holder is integral with the truss body.

16. The pin holder of claim 9 wherein the pins are ferromagnetic and the holder is magnetized to allow the pins to adhere to it due to the magnetic force.

* * * * *